US005194708A

United States Patent [19]

Carter, Jr.

[11] Patent Number: 5,194,708

[45] Date of Patent: Mar. 16, 1993

[54] TRANSVERSE ELECTRIC HEATER

[75] Inventor: Philip S. Carter, Jr., Palo Alto, Calif.

[73] Assignee: Metcal, Inc., Menlo Park, Calif.

[21] Appl. No.: 571,787

[22] Filed: Aug. 24, 1990

[51] Int. Cl.[5] ..... H05B 6/12

[52] U.S. Cl. ..... 219/10.493; 219/10.41; 219/10.51; 219/10.65; 219/10.79

[58] Field of Search ..... 219/10.41, 10.43, 10.491, 219/10.493, 10.51, 10.75, 10.57, 10.65, 10.79, 10.67

[56] References Cited

U.S. PATENT DOCUMENTS

| | | | |
|---|---|---|---|
| 3,520,053 | 7/1970 | Hinton et al. | 219/10.53 |
| 3,591,770 | 7/1971 | Ando | 219/10.51 |
| 3,979,572 | 9/1976 | Ito et al. | 219/10.493 |
| 4,110,599 | 8/1978 | Offermann | 219/10.51 |
| 4,177,446 | 12/1979 | Diaz | 219/552 |
| 4,185,632 | 1/1980 | Shaw | 219/233 |
| 4,252,692 | 2/1981 | Taylor et al. | 252/504 |
| 4,256,945 | 3/1981 | Carter et al. | 219/10.75 |
| 4,304,987 | 12/1981 | Van Konynenburg | 219/553 |
| 4,314,230 | 2/1982 | Cardinal et al. | 338/314 |
| 4,314,231 | 2/1982 | Walty | 338/328 |
| 4,467,162 | 8/1984 | Kondo et al. | 219/10.493 |
| 4,560,849 | 12/1985 | Migliori | 219/10.51 |
| 4,745,264 | 5/1988 | Carter | 219/10.75 |
| 4,794,226 | 12/1988 | Derbyshire | 219/10.75 |
| 4,914,267 | 4/1990 | Derbyshire | 219/85.1 |
| 4,983,804 | 1/1991 | Chan et al. | 219/10.41 |

*Primary Examiner*—Philip H. Leung
*Attorney, Agent, or Firm*—Howard L. Rose

[57] ABSTRACT

A temperature self-regulating heater has a thin first layer of high magnetic permeability, a second layer of electrically conductive non-magnetic material forming a substrate and a heat conductive dielectric disposed between the layers. A varying (preferably r.f.) magnetic field is imposed upon the exposed surface of the first layer and the material to be heated may be placed in contact with an exposed surface of the second layer or may be the dielectric. The heater may be employed with an induction stove wherein the first layer is disposed above the stove's induction coil and the second layer can be the bottom of a cooking utensil.

20 Claims, 4 Drawing Sheets

Fig.3
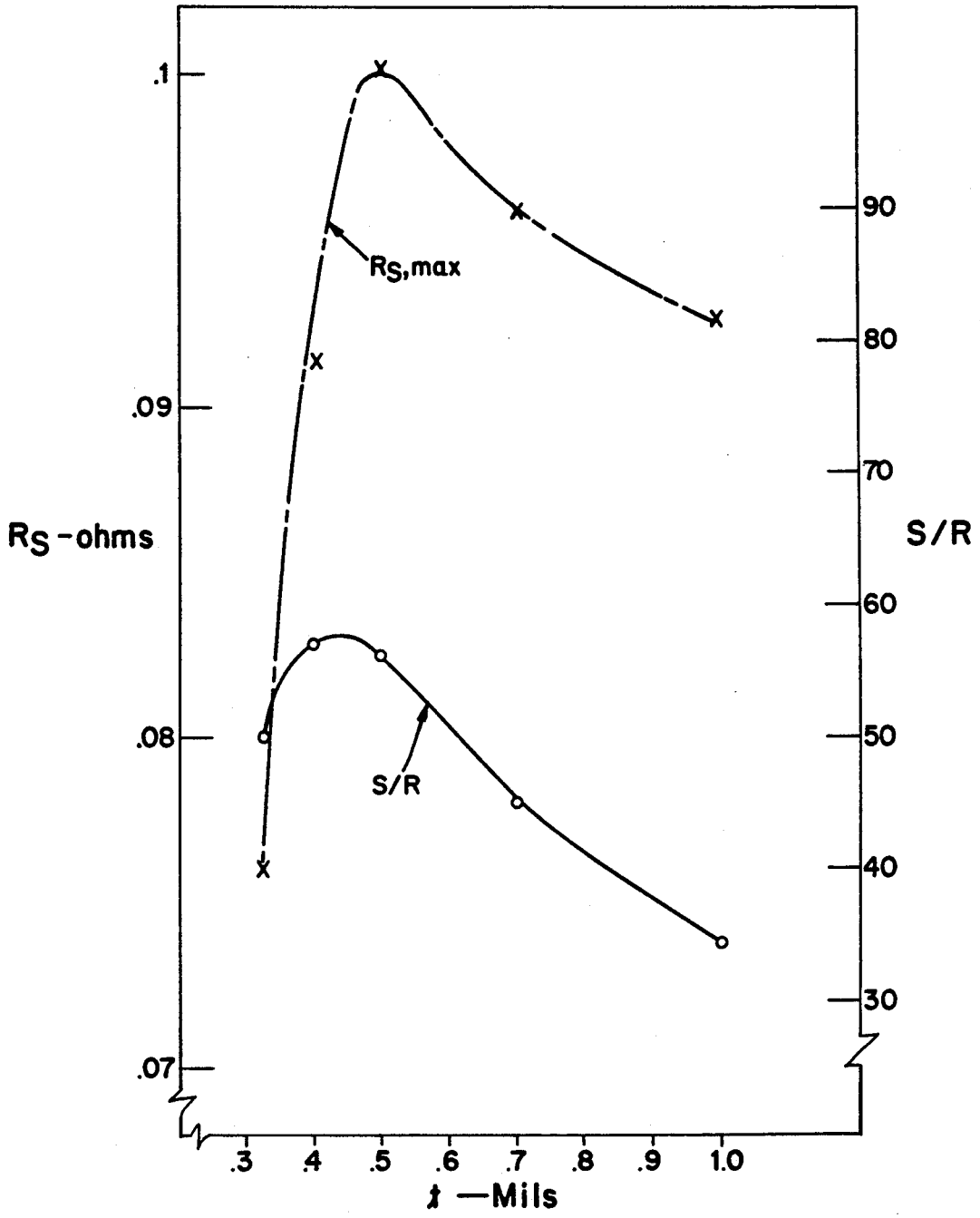
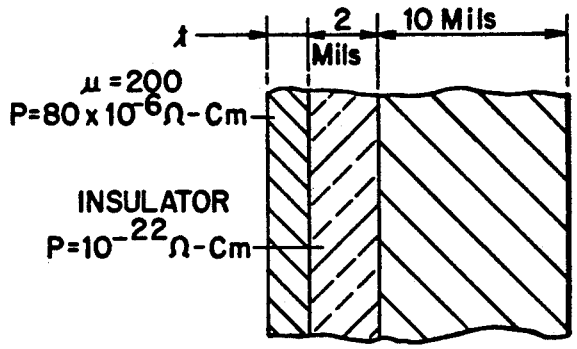
Fig.3a

TRANSVERSE ELECTRIC HEATER

BACKGROUND OF THE INVENTION

The present invention relates to temperature self regulating heaters and methods and more particularly to temperature self regulating heaters and methods employing resistance heating in ferromagnetic metals.

Temperature self regulating heaters employing the Curie temperature of a ferromagnetic member as the regulating member are disclosed in a number of patents such as U.S. Pat. Nos. 4,185,632; 4,256,945; 4,745,264; 4,794,226 and others. In U.S. Pat. No. 4,185,632 a constant alternating current at frequencies in the megahertz range is passed in series through a ferromagnetic member which is heated primarily by Joule heating until it approaches its Curie temperature. Below the Curie temperature as a result of skin effect and the high frequencies employed, the current is confined to a narrow region adjacent a surface of the ferromagnetic member. Current density is quite high and $I^2R$ heating is effective to cause the ferromagnetic member to approach its Curie temperature and become non-magnetic. The current then spreads into the ferromagnetic member which in consequence exhibits a materially reduced resistance to current flow. Since current is held constant and the resistance is materially reduced the temperature falls and an equilibrium temperature is established near the effective Curie temperature and maintained until the heater is subjected to a change in load.

In U.S. Pat. No. 4,256,945, a substrate of non-magnetic, conductive material such as copper is placed in thermal electrical contact with a layer of ferromagnetic material of 1 to 2 skin depths at the frequency of operation, for instance, 13.56 MHz. When the temperature of the device approaches Curie temperature the permeability of the material, $\mu$, approaches one; and the current spreads primarily into the conductive layer whereby a very material change in resistance is affected. Autoregulation ratios of as high as 160 are available depending upon the initial permeability and resistivity of the ferromagnetic material.

The excitation of such a heater may be accomplished by an induction field excited by a constant current wherein the field is applied to the ferromagnetic material. Such a device is illustrated in FIG. 5 of U.S. Pat. No. 4,745,264. Eddy current and hysteresis losses are induced in the ferromagnetic material producing rapid heating therein. As Curie temperature is approached the coupling is greatly reduced and the current produced in the ferromagnetic layer spreads into a copper substrate further reducing heating. Again, an equilibrium condition is established until the load on the heater is changed.

In U.S. Pat. No. 4,794,226, there is disclosed a Self Regulating Porous Heater wherein a porous ferromagnetic material is dispersed across a path of fluid flow to provide intimate contact between the fluid to be heated and the heater. A flowing fluid heater is also disclosed in FIG. 4 of U.S. Pat. No. 4,256,945 but contact between the fluid and the heated surface is far less than in the porous type heater device. The device in the '945 patent provides far less resistance to flow than the former device but as indicated does not provide the intimate contact between fluid and heater of the porous heater.

It should be noted that the heaters described above are employed to heat solids only on one side whereas in many instances heating from two sides of a body produces more rapid and uniform heating. Additional drawbacks which occur in certain specific applications result from unequal temperature coefficients of expansion of the laminated structures and the inability to change the material of a given Curie temperature for a material of another Curie temperature without changing the entire structure.

BRIEF DESCRIPTION OF THE PRESENT INVENTION

In accordance with the present invention a new form of self regulating heater structure employing resistance heating of ferromagnetic, ferrimagnetic or other high permeability material (hereinafter generally "ferromagnetic material") is disclosed. In the self regulating Curie temperature heater of the present invention, a three layer device is disclosed which includes a high resistance magnetically permeable material and a low resistance, non-magnetic material such as copper, aluminum or the like separated by a solid, liquid or gaseous material that is heat conductive, transmissive or absorptive, but not electrically conductive. In the case of a high temperature heater where heat transmission is primarily by radiation rather than conduction, the separating layer may be, if desired, a vacuum. In this application, the term "heat conductive" is used to connote all forms of heat transmission through the middle layer. A means for inducing an alternating electromagnetic field at the surface of the ferromagnetic material is provided which field propagates in a direction perpendicular to the planes of the layers. Thus, the field induces electric fields in both of the outer layers producing currents in them which result in $I^2R$ heating. Power is absorbed from the electromagnetic wave energy and heats both the ferromagnetic member and the conductive member, the outer members. The heating induced directly in the copper layer is far less than in the ferromagnetic layer. Thus there is a requirement for a heat transmissive middle layer to cause the copper layer to also approach Curie temperature of the ferromagnetic layer. When the ferromagnetic layer approaches Curie temperature the field coupled to the copper layer increases and the $I^2R$ losses in the copper increase but again not to a temperature exceeding Curie temperature due to the very low resistivity of copper. Although copper is referred to herein as the low resistance outer layer it is obvious that any low resistance, nonmagnetic material can be used, for instance silver, aluminum, etc.

The region between the outer members is also heated so that not only can the heater heat material external to the heater as with the devices of the cited patents and others of the same type but also it can be used to heat materials to be treated when used as the electrically insulating member between the outer layers. In such instances, frequencies as low as or below 20 KHz must be used to provide allowable spacing between of outer members of about 1/16 inch, higher frequencies making it basically impractical to use the device for such purposes as will become apparent. In a cylindrical device with a liquid as the center layer, a 1/16 inch spacing provides better flow through than most porous devices but greatly increases the contact of fluid with the walls of the device relative to that disclosed in the '945. Heating of thin solid materials may also be undertaken. The heater may also be beneficially employed with an induction stove wherein a ferromagnetic plate having a surface coated with a dielectric (a high temperature paint for instance) is placed on the top of the stove over a coil and a pot with an electrically conductive bottom, such as, copper or a common aluminum pan, is placed on the plate. Heating is quick, efficient and temperature control is excellent.

The main advantages of the present invention, however, are the separation of the outer layer and the ability to change Curie temperatures. In the former case the material differences in the temperature coefficients of expansion of the outer layers can be accommodated. The middle layer can be chosen such that it can in effect expand at different rates on its two surfaces without straining the adjacent layers and does not have the strength to produce warping.

The ability to change the ferromagnetic layer is obvious since the ferromagnetic layer need not be secured to the middle layer. Specifically, the middle layer can be bonded or otherwise secured to either of the layers or to neither of the layers and the ferromagnetic layer can be pressed into contact with the adjacent layer by a device that carries the coils for providing the magnetic flux.

OBJECTS OF THE INVENTION

It is an object of the present invention to provide a temperature self regulating heater comprising a ferromagnetic layer, a non-magnetic, highly conductive layer and a heat transmissive, non-electrically conductive layer therebetween.

It is another object of the present invention to provide a temperature self regulating heater having a removable ferromagnetic layer, a non-magnetic highly conductive layer and therebetween a heat conductive, electrically insulating layer with said middle layer preferably bonded to one or the other of the layers.

It is still another object of the present invention to provide a temperature self regulating heater that can heat a load from two sides concurrently.

BRIEF DESCRIPTION OF THE DRAWINGS

FIG. 3 provides graphs of surface resistance and regulation ratio as a function of thickness of the magnetic layer of the heater of FIG. 1;

FIG. 3*a* illustrates the device the performance characteristics of which are illustrated by the graph of FIG. 3;

DETAILED DESCRIPTION OF THE PRESENT INVENTION

Figure 1:
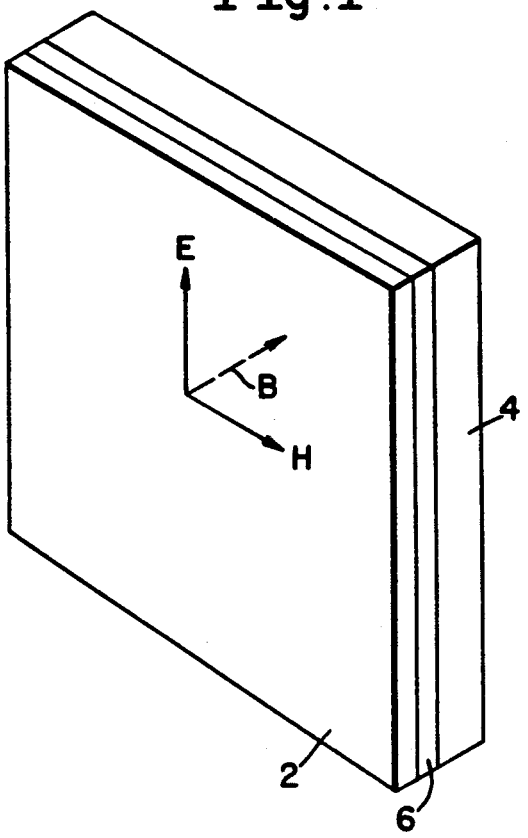
FIG. 1 is a diagram of the magnetic and electric fields produced in the ferromagnetic plate of the heater by a varying magnetic field.

Referring specifically to FIG. 1 of the accompanying drawings, there is illustrated a vector diagram of the fields generated by the magnetic field superposed on a perspective view of the structure of the heater of the present invention.

The structure comprises a ferromagnetic layer 2, a non-magnetic, a highly conductive layer 4 which may be copper, silver, aluminum or other non-magnetic, highly conductive material, and a layer of heat conductive, non-electrically conductive (dielectric) material such as, aluminum nitride, berylium oxide or anodized aluminum as solids and water and some oils and others as liquids. In the case of a very high temperature heater where heat transmission by radiation predominates the middle layer may be a vacuum or a gas.

A varying electromagnetic field is established at the surface of the layer 2 (by means to be disclosed hereinbelow) producing the H and E vectors. The electromagnetic field propagates through the ferromagnetic layer toward the layer 4 as indicated by dashed line 8 which is perpendicular to the plane of the layers 2, 4 and 6. The field E produces currents in the layer 2 thereby heating the layer, the heat is conducted through layer 6 to layer 4 which is also heated to some extent by the coupling of the electromagnetic field to that layer. The heating of the layer 4 by the electromagnetic field is small compared to that of the layer 2 because (1) the resistance of the conductive layer 4 is quite low compared with that of layer 2, $\approx$37:1 for instance, and (2) much of the electromagnetic field is absorbed by the layer 2.

More specifically power is absorbed by the layer 2 as the field penetrates the layer, some of the electromagnetic field is reflected at the interface between layers 2 and 6, additional reflections occur in the dielectric layer 6 and at the surface of the layer 4 as a result to some extent of the currents generated therein by the electromagnetic field.

In analyzing the operation of the apparatus of the present invention use is made of the equivalency of plane waves and of waves on a TEM mode transmission line. The following analysis is based on TEM mode equations.

Initially, $$i=\sigma E \tag{1}$$

where i is the current density in amperes per square meter, $\sigma$ is the conductivity of the ferromagnetic layer in mhos per meter. The absorbed power density P is $$P=i^2/\sigma \text{ watts per cubic meter}$$

The surface resistance of the heater is given by $$Z_s=R_s+X_s$$

where $Z_s$ is the surface impedance in ohms per square, $R_s$ is surface resistance in ohms per square and $X_s$ is surface reactance in ohms per square. Thus $$Z_s=E(X=O)/J$$

where J is the integrated total current per unit width (meters) in both conductive layers and E(X=0) is the electric field in volts per meter at the surface of the heater.

Figure 2:
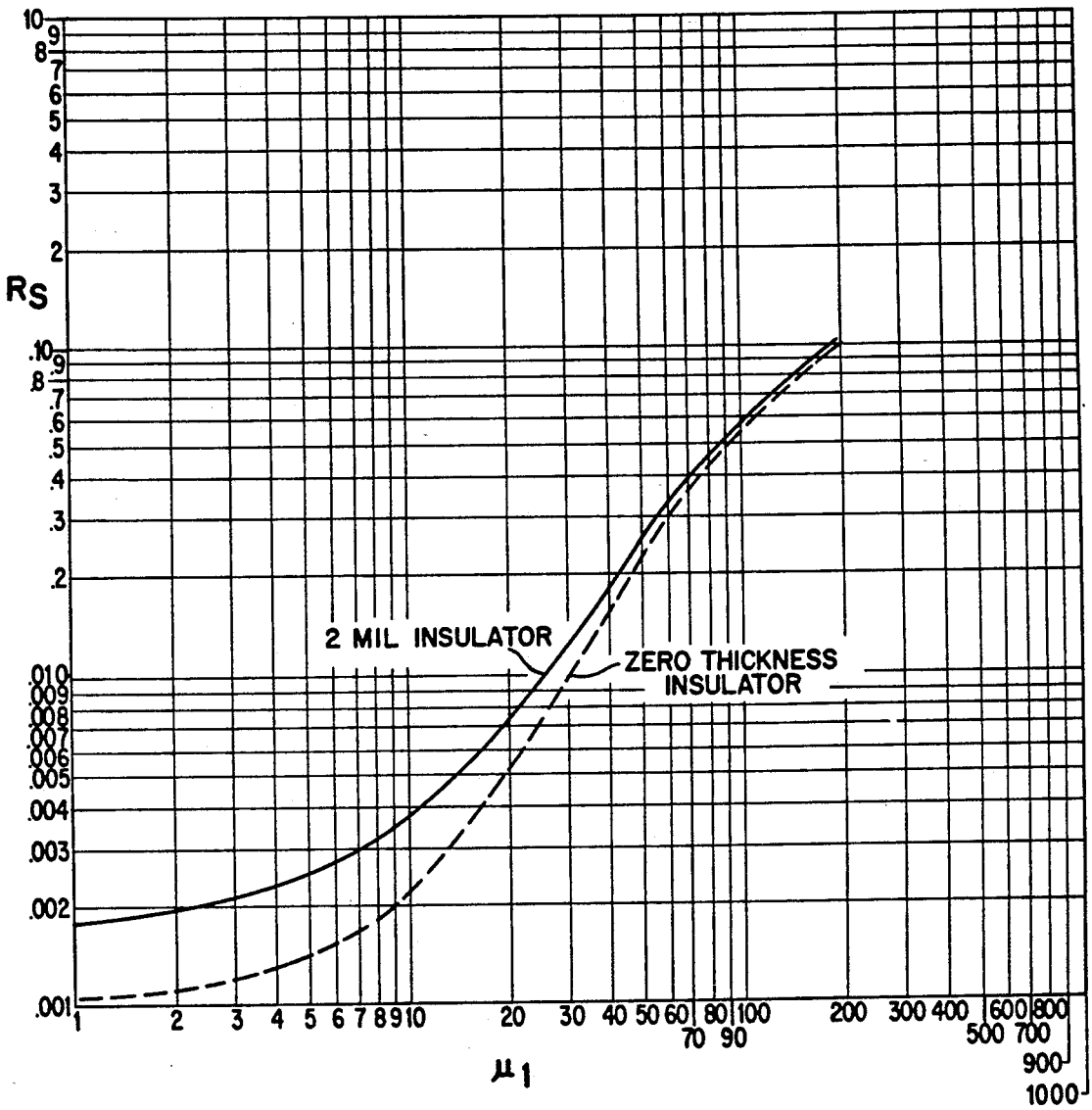
FIG. 2 is a graph of surface resistance versus magnetic permeability of the heater of FIG. 1.
Figure 2A:
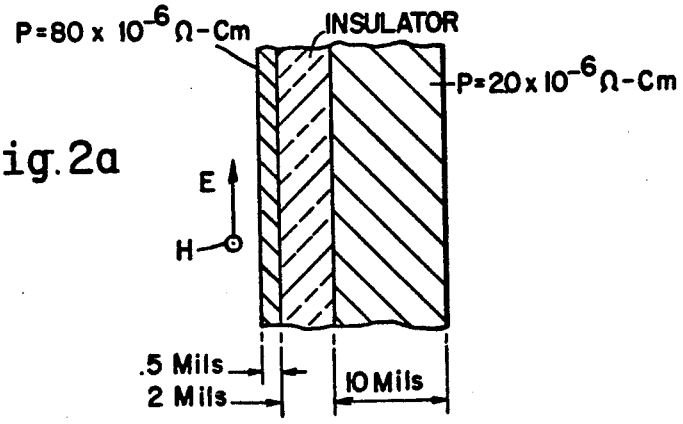
FIG. 2*a* illustrates the device the performance characteristics of which are illustrated by the graph of FIG. 2.

FIG. 2 is a graph of a surface resistance of the device illustrated in FIG. 2a as a function of permeability over a permeability range from 1 to 200 on log log graph paper. The structure of FIG. 2 employs a copper support of 10 mils and a resistivity of $2.0\times10^{-6}$ ohm-cm, a layer 6 of 2 mils and a ferromagnetic layer 2 of 0.5 mil with a resistivity of $80\times10^{-6}$ ohm-cm. The solid line curve assumes a dielectric thickness of 2 mils and the dashed line curve assumes a thickness of 0 mils. Variations in dielectric constants from a range of 1 to 10 had negligible effect. A constant current source of 13.56 MHz was assumed. The power per unit area and thus Joule heating is determined by the equation $$P_s=|J|^2R_s$$

It is readily apparent that as the permeability of the ferromagnetic layer increased the surface resistance and, therefore, the power increased dramatically.

In practice it is intended that the layer 4 which is a heat conductor be in contact with the body or material (the load) to be heated. The heat conductive path through the layers 4 and 6 to layer 2 causes this latter layer to respond rapidly to changes in the temperatures of the load. As heat is transferred to the load the temperature of the load rises and the temperature of the layer 2 rises so that the Curie temperature of the layer 2 is rapidly approached and maintained at an equilibrium temperature until there is a further change in the load.

Referring to FIG. 3 there is plotted against magnetic layer thickness over a range from 0.3 to 1.0 mils of the device illustrated in FIG. 3a, two curves, one for maximum surface resistance $R_s$, max and one for self regulation ratio S/R; the latter being the ratio of maximum surface resistance at $\mu=200$ to the surface resistance when $\mu=1$. It is noted that the maximum surface resistance, 0.1 ohm per square, occurs at a layer thickness of 0.5 mils while the maximum S/R ratio of approximately 57 occurs about half-way between 0.4 and 0.5 mil. Again, the frequency of the constant current source is 13.56 MHz so that the skin depth in a magnetic layer of $\mu=200$ is about 0.34 mil and the 0.5 mil thickness is about 1.5 skin depths. For other frequencies the skin depth varies according to the equation $$S.D. = 5030\sqrt{\frac{\rho}{\mu f}}$$

where $\rho$ is the resistivity in ohm centimeters, $\mu$ is the permeability, and $f$ is the frequency in Hertz. It is noted that a thickness of 2 mils is chosen for the layer 6. This thickness is also a function of frequency approximately as follows:

$$t \approx \sqrt{\frac{f_1}{f_2}}\, t_1$$

where $f$, in this example is 13.56 MHz, t is the thickness of the layer 6 at 13.56 MHz. If a lower frequency of for instance 15 KHz is chosen then $$t = \sqrt{\frac{13.56\times10^6}{15\times10^3}}$$

$t$ = 60 mils, or slightly less than 1/16 inch. In any event a substantial self regulating ratio is obtained.

Figure 4:
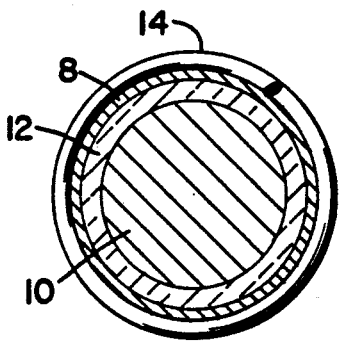
FIG. 4 illustrates a structure employed to heat a fluid.

Referring specifically to FIG. 4 of the accompanying drawings there illustrated a structure employed to heat a liquid. The device has a hollow magnetic cylinder 8, a solid cylindrical core 10 of preferably copper or silver and an empty hollow cylindrical space 12 adapted to receive an electrically insulating fluid to be heated. Such fluid may be water, oil or other fluid to be heated. Such fluid may be water, oil or other substance, liquid or gas having such characteristics.

The advantage to this type of heater over that of FIG. 4 of the '945 patent is the intimate contact between the fluid and the walls provided by the present apparatus. The through flow cannot be as great for a given external diameter as the '945 device but the temperature of the fluid is more uniform due to the small space between the heated walls defining the space 12.

Figure 5:
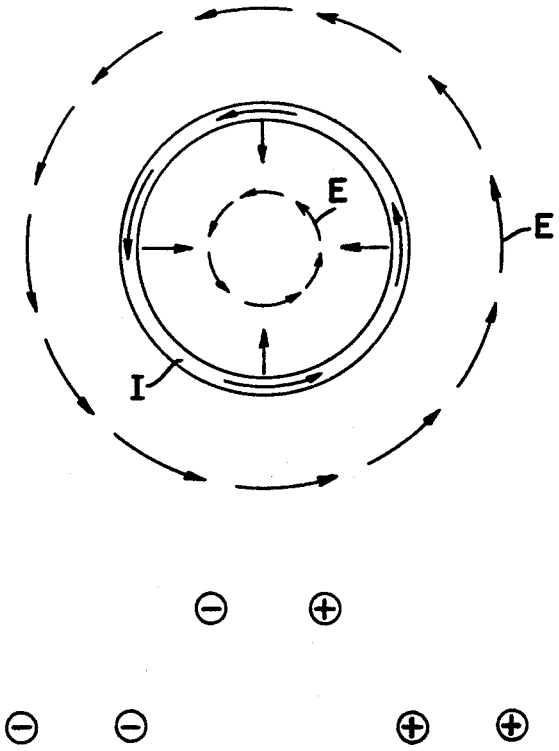
FIG. 5 illustrates the electric field patterns of the heater of FIG. 4.

In the structure of FIG. 4, the coil for producing magnetic flux at the surface of the cylinder 8 is as illustrated in and described relative to FIG. 5 of U.S. Pat. No. 4,745,264; the substance of which is incorporated herein by reference. The coil is schematically illustrated as coil 14 in FIG. 4 hereof.

Figure 6:
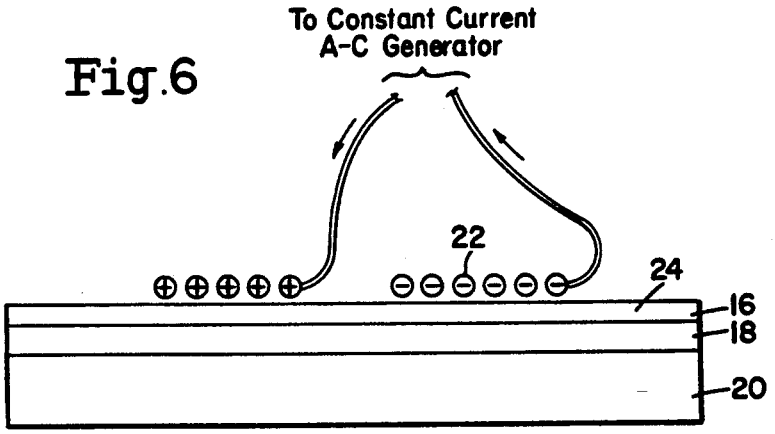
FIG. 6 illustrates a heater of the present invention with an induction coil applied to the exposed surface of the ferromagnetic layer.

The helical coil and cylindrical structure provides an essentially transverse electric field oriented tangent to the cylindrical heater layers. This result is current carrying circular wire loop is circular everywhere as shown in FIG. 5. Thus a circular AC current carrying loop can be considered to be launching an inwardly radially directed cylindrical wave toward the center of the loop. This version is the counterpart of the plane wave situation upon which the above description is based. The above plane wave heater analysis is applicable to the cylindrical heater structure of FIG. 4 provided that (1) the magnetic and insulating layer thicknesses are thin compared with their cylinder radius and (2) the core diameter is at least 10 skin depths measured in the core material. The heater performs quite well even if these conditions are not met since the transverse electric wave picture is still valid although the plane wave approximation presented above is not quantitatively accurate.

Where the surface of the heater is flat the structure of FIG. 6 is employed. The heater again comprises three layers, a ferromagnetic layer 16, a heat conductive, electrically insulating layer 18 and an substrate layer 20 of electrically conductive, non-magnetic material. A spiral coil 22 of wire is connected to a constant current source and is wound flat on top of the exposed surface 24 of layer 16. The coil when energized produces fields, magnetic (H) and electrical (E) as illustrated in FIG. 1 of the accompanying drawings.

Figure 7:
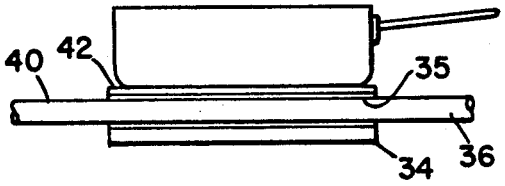
FIG. 7 illustrates the use of the present invention in conjunction with an induction stove.

In a test a ferromagnetic plate of Alloy 36 of a thickness of 0.030 inch was placed on an induction coil stove. The plate was coated with high temperature electrically insulating paint and an aluminum pot placed on the plate. Water boiled between 1 and 2 minutes. Also bacon was cooked in the pot with no burning and eggs were fried without becoming brown around the edges, these affects resulting from the temperature regulation provided by the ferromagnetic material. This arrangement is illustrated in FIG. 7 wherein induction coil 34 of the stove is located under the upper wall 36 of the stove. A ferromagnetic plate 38 is disposed on surface 40 of wall 36 and has a layer 42 of dielectric material, such as high temperature paint on its upper surface as viewed in FIG. 7. An aluminum pot or pot of other good electrical and heat conductive material is located on the dielectric surface. Excellent temperature stability in the pot was observed.

It is noted that in a heater for producing very high temperatures; such as; 500° C. (2.1 watts/sq.cm.) the substrate layer is heated by infra-red radiation as well as conduction through the dielectric. The dielectric is vertically transparent to infra-red radiation so that the substrate is very closely coupled temperaturewise to the ferromagnetic material. Thus efficiency is higher at the higher temperatures.

Figure 8:
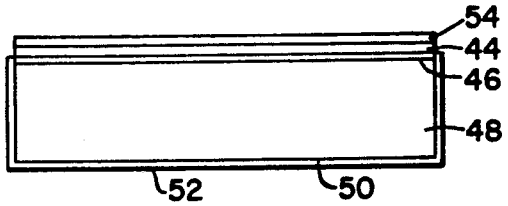
FIG. 8 is a drawing of the heater of the present invention with an optical and infra-red frequency reflector applied to the exposed surface of the substrate.

Increased heating efficiency is also achieved at the high temperatures by placing a layer of an optical and infra-red reflective material on the external surfaces of the conductive layer and on the surface of the heater layer facing the coil. Referring to FIG. 8, the heater comprises a layer 44 of a high Curie temperature ferromagnetic material, such as Alloy 36, an electrically non-conductive layer 46 and a conductive, non-magnetic substrate 48. Surface 50 of substrate 48 opposite layer 46 and the sides thereof are coated with an optical and infra-red reflective layer 52 which may be a few angstroms of vapor-deposited aluminum or silver or the like. Also, the surface 53 of the ferromagnetic layer is coated at 54 with same or like material. As indicated these layers reflect optical and infra-red radiation and increases the efficiency of the heater.

Figure 9:
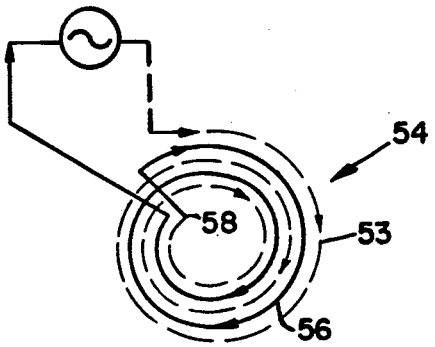
FIG. 9 is an illustration of a two layer coil.

If a single layer of coil does not produce sufficient field in a given situation layers of wire may be employed as long as the current proceeds in the same direction at all times through the various layers of the coil. An arrangement for producing such a result is illustrated in FIG. 9 of the accompanying drawings. The dashed line 53 indicates one layer of a coil 54 and the heavy line 56 indicates another layer of the coil. The connection 58 between the layers of the coil 54 insures that current flows in the same direction in both coils.

The current supplied to the coils should be a constant current. The term "constant current" as employed herein does not mean a current that cannot increase, but means a current that obeys the following formula $$\frac{\Delta|I|}{|I|} < -\frac{1}{2}\frac{\Delta R}{R}$$

where I is the load current and R is the resistance coupled to the coil by the reaction of currents induced in the ferromagnetic heater plate and the substrate. Specifically, in order to autoregulate, the power delivered to the load when the heater exceeds Curie temperature, must be less than the power delivered to the load below Curie temperature. If the current is held invariable, then the best autoregulating ratio is achieved short of controlling the power supply to reduce current. So long, however, that the current is controlled in accordance with the above formula, autoregulation is achieved. Thus, when large self regulating ratios are not required, constraints on the degree of current control may be relaxed thus reducing the cost of the power supply.

The term "Curie temperature" refers to the temperature at which a magnetically permeable material becomes truly paramagnetic. For purposes of the present invention the term refers to the temperature at which a material's permeability has been reduced to the degree necessary to produce autoregulation. The temperature required for this purpose may be as little as one degree below true Curie temperature or as much as one hundred degrees below such temperature depending upon the material.

Many variations and modifications of the above-described embodiments are within the ordinary skill of the skilled artisan in this art, without departing from the scope of the invention. Accordingly, those modifications and embodiments are intended to fall within the scope of the invention as defined by the following claims.

I claim:

1. A temperature self-regulating heater comprising
a layer of high permeability material,
a layer of non-magnetic, electrically conductive material,
a heat conductive dielectric disposed between and in contact with said layers,
a coil for producing a varying magnetic field of sufficient intensity to heat said high permeability material to a temperature approaching its Curie temperature.

2. A temperature self-regulating heater according to claim 1 wherein
said coil is a flat coil wound parallel to and placed close to a surface of said high permeability material remote from said dielectric.

3. A temperature self-regulating heater according to claim 1 further comprising
an optical and infra-red reflective material dispersed on a surface of said layer of electrically conductive material remote from said dielectric.

4. A temperature self-regulating heater according to claim 1 wherein
said dielectric is a material to be heated by said heater.

5. A temperature self-regulating heater according to claim 1 or 4 wherein said dielectric is a fluid.

6. A temperature self-regulating heater according to claim 1 or 4 wherein
said dielectric is oil.

7. A temperature self-regulating heater according to claim 1 further comprising
means for connecting said coil to a source of radio frequency current.

8. A temperature self-regulating heater according to claim 1 wherein
said dielectric is a heat conductive paint.

9. A temperature self-regulating heater according to claim 1 further comprising
a cooking pot having an electrically conductive bottom surface,
said cooking pot contacting said dielectric.

10. A temperature self-regulating heater according to claim 1 wherein
an induction stove
said coil comprising the coil of said induction stove,
said high permeability material is disposed in alignment with and parallel to said coil,
a wall located between said coil and said high permeability material.

11. A temperature self-regulating heater according to claim 1 wherein said layers are coaxial, aligned cylinders.

12. A temperature self-regulating heater according to claim 11 wherein said dielectric is a fluid, and said cylinders are spaced from one another to provide a channel between them.

13. A method of heating a substance by a heater having a first layer of high magnetic permeability and a Curie temperature at about the maximum temperature to which a substance is to be heated, a second layer of nonmagnetic, electrically conductive material and a heat conductive dieletric disposed between the layers, said method comprising selecting a first layer having a Curie temperature to provide the desired heater temperature, subjecting the first layer to a varying magnetic field of sufficient intensity to cause the first layer to approach its Curie temperature, contacting at least one of the layers with a material to be heated.

14. A method of heating a substance by a heater according to claim 13 flowing a heat conductive dielectric fluid between the layers to provide the dielectric.

15. A method of heating a substance by a heater according to claim 14 forming the layers as aligned, spaced apart, concentric cylinders.

16. A method of heating a substance by a heater according to claim 13 for use with an induction heater having an induction coil located adjacent one side of a support member with the first layer having the dielectric disposed in contact with one surface thereof, comprising the steps of placing the first layer aligned with the induction coil on a side of the support opposite the induction coil with the dielectric layer exposed, and placing a member having at least a conductive surface on the dielectric material with the conductive surface contacting the dielectric material.

17. A method of heating a substance comprising placing a layer of ferromagnetic material in contact with a surface of a heat conductive dielectric, placing an electrically conductive non-magnetic material in contact with a surface of the dielectric material different from that contacted by the ferromagnetic layer, placing a coil adjacent the ferromagnetic layer, placing one of the ferromagnetic layer and the electrically conductive material in contact with a substance to be heated, and energizing the coil.

18. A heater mechanism comprising a layer of magnetically high permeability material, a layer of electrically conductive non-magnetic material, a layer disposed between said first two mentioned layers of a heat conductive dielectric material, and means for inducing an alternating electromagnetic field at a surface of said first mentioned layer that propagates through and in a direction perpendicular to the planes of the layers.

19. A heater mechanism comprising a layer of magnetically high permeability material, a layer of electrically conductive non-magnetic material, a layer disposed between said first two mentioned layers of a heat conductive dielectric material, and means for inducing electric fields in both the ferromagnetic and electrically conductive layers to produce $I^2R$ heating.

20. A heater mechanism according to claim 19 wherein said ferromagnetic layer and said conductive layer are coaxial cylinders with the latter inside the former, and wherein said dielectric is a fluid located between said cylinders.

* * * * *